US006128817A

United States Patent [19]

Roessler et al.

[11] Patent Number: 6,128,817

[45] Date of Patent: Oct. 10, 2000

[54] METHOD OF MANUFACTURING A POWER MAGNETIC DEVICE MOUNTED ON A PRINTED CIRCUIT BOARD

[75] Inventors: Robert Joseph Roessler, Rowlett, Tex.; Lennart Daniel Pitzele, Redwood Falls, Minn.

[73] Assignee: Lucent Technologies Inc., Murray Hill, N.J.

[21] Appl. No.: 09/045,217

[22] Filed: Mar. 20, 1998

Related U.S. Application Data

[63] Continuation of application No. 08/940,557, Sep. 30, 1997, which is a continuation of application No. 08/434,485, May 4, 1995, abandoned.

[51] Int. Cl.[7] ..... H01F 41/02

[52] U.S. Cl. ..... 29/606; 29/602.1; 29/840

[58] Field of Search ..... 29/606, 602.1, 29/840; 336/65, 200

[56] References Cited

U.S. PATENT DOCUMENTS

| | | | |
|---|---|---|---|
| Re. 33,541 | 2/1991 | Pryst et al. | 338/226 |
| 3,504,276 | 3/1970 | Proctor et al. | 324/37 |
| 3,965,287 | 6/1976 | Mueller | 174/66 |
| 4,641,114 | 2/1987 | Person | 333/161 |
| 4,672,358 | 6/1987 | Pryst et al. | 338/226 |
| 4,975,671 | 12/1990 | Dirks | 336/65 |
| 5,025,305 | 6/1991 | Tomisawa et al. | 357/72 |
| 5,050,038 | 9/1991 | Malaurie et al. | 361/386 |
| 5,055,971 | 10/1991 | Fudala et al. | 361/400 |
| 5,093,774 | 3/1992 | Cobb | 361/306 |
| 5,103,071 | 4/1992 | Henschen et al. | 219/85.22 |
| 5,161,098 | 11/1992 | Balakrishnan | 363/144 |
| 5,179,365 | 1/1993 | Raggi | 336/65 |
| 5,182,536 | 1/1993 | Boylan et al. | 336/65 |
| 5,184,103 | 2/1993 | Gadreau et al. | 336/84 |
| 5,221,212 | 6/1993 | Davis | 439/108 |
| 5,235,311 | 8/1993 | Person et al. | 338/32 R |
| 5,267,218 | 11/1993 | Elbert | 365/226 |
| 5,300,911 | 4/1994 | Walters . | |
| 5,337,396 | 8/1994 | Chen et al. | 385/92 |
| 5,345,670 | 9/1994 | Pitzele et al. | 29/606 |
| 5,488,765 | 2/1996 | Kubota et al. . | |

FOREIGN PATENT DOCUMENTS

| | | | |
|---|---|---|---|
| 0 267 108 | 5/1988 | European Pat. Off. | H01F 5/00 |
| 0 608 127 A1 | 7/1994 | European Pat. Off. | H01F 27/28 |
| 61-075510 | 4/1986 | Japan | H01F 27/28 |
| 3-78218 | 4/1991 | Japan | H01F 31/00 |
| 3-183106 | 8/1991 | Japan | H01F 17/00 |
| 3-283404 | 12/1991 | Japan | H01F 5/00 |
| 5-82350 | 4/1993 | Japan | H01F 17/00 |
| 5-135968 | 6/1993 | Japan | H01F 31/00 |
| 5-59818 | 8/1993 | Japan | H01F 27/28 |
| 5-291062 | 11/1993 | Japan | H01F 31/00 |
| 6-163266 | 6/1994 | Japan | H01F 15/10 |

*Primary Examiner*—Carl E. Hall

[57] ABSTRACT

A surface-mountable magnetic device comprising: (1) a multi-layer circuit containing a plurality of windings disposed in layers thereof, the multi-layer circuit having first and second lateral recesses associated therewith, the first and second lateral recesses intersecting the layers of the multi-layer circuit, (2) a conductive substance disposed within the first and second lateral recesses and electrically coupling selected ones of the plurality of windings and (3) a magnetic core mounted proximate the plurality of windings, the magnetic core adapted to impart a desired magnetic property to the plurality of windings, the device locatable proximate a substantially planar substrate to allow the first and second lateral recesses to act as conductors between the plurality of windings and electrical conductors on the substantially planar substrate, the plurality of windings and the magnetic core substantially free of a surrounding molding material to allow the magnetic device to assume a smaller overall device volume.

10 Claims, 2 Drawing Sheets

METHOD OF MANUFACTURING A POWER MAGNETIC DEVICE MOUNTED ON A PRINTED CIRCUIT BOARD

This is a continuation of U.S. patent application Ser. No. 08/940,557, entitled "Power Magnetic Device Employing a Leadless Connection to a Printed Circuit Board and Method of Manufacturing Thereof," to Pitzele, et al., filed on Sep. 30, 1997, which is a file-wrapper continuation of U.S. patent application Ser. No. 08/434,485, entitled "Power Magnetic Device Employing a Leadless Connection to a Printed Circuit Board and Method of Manufacturing Thereof," to Pitzele, et al., filed on May 4, 1995, now abandoned. The above-listed applications are commonly assigned with the present invention and are incorporated herein by reference as if reproduced herein in its entirety.

TECHNICAL FIELD OF THE INVENTION

The present invention is directed, in general, to magnetic devices and, more specifically to an inexpensive, readily mass-producible, surface-mountable power magnetic device having a relatively high power density and small footprint.

BACKGROUND OF THE INVENTION

Power magnetic devices, such as inductors and transformers, are employed in many different types of electrical circuits, such as power supply circuits. In practice, most power magnetic devices are fabricated of one or more windings, formed by an electrical member, such as a wire of circular or rectangular cross section, or a planar conductor wound about or mounted to a bobbin composed of dielectric material, such as plastic. In some instances, the electrical member is soldered to terminations on the bobbin. Alternatively, the electrical member may be threaded through the bobbin for connection directly to a metallized area on a circuit board. A magnetic core is typically affixed about the bobbin to impart a greater reactance to the power magnetic device.

As with other types of electronic components, there is a trend in the design of power magnetic devices toward achieving increased power and volumetric density and lower device profile. To achieve higher power, the resistance of the power magnetic device must be reduced, typically by increasing the cross-sectional area of the electrical member forming the device windings, or by simply reducing the electrical path length of the device. To increase the density of the power magnetic device, the bobbin is usually made relatively thin in the region constituting the core of the device to optimize the electrical member resistance. Conversely, the remainder of the bobbin is usually made relatively thick to facilitate attachment of the electrical member to the bobbin terminals or to facilitate attachment of terminals on the bobbin to a circuit board. As a result of the need to make such a bobbin thin in some regions and thick in others, the bobbin is often subject to stresses at transition points between such thick and thin regions.

Another problem associated with present-day power magnetic devices is the lack of co-planarity of the device terminations. Because of the need to optimize the winding thickness of the power magnetic device to provide the requisite number of turns while minimizing the winding resistance, the thickness of the electrical member forming each separate winding of the device is often varied. Variation in the winding thickness often results in a lack of co-planarity of the device terminations, an especially critical deficiency when the device is to be mounted onto a surface of a substrate, such as a printed circuit board ("PCB") or printed wiring board ("PWB").

A surface-mounted power magnetic device is disclosed in U.S. Pat. No. 5,345,670, issued on Sep. 13, 1994, to Pitzele, et al., entitled "Method of Making a Surface Mount Power Magnetic Device," commonly assigned with the present invention and incorporated herein by reference. The power magnetic device of Pitzele, et al. is suitable for attachment to a substrate (such as a PWB) and includes at least one sheet winding having a pair of spaced-apart terminations, each receiving an upwardly rising portion of a lead. The sheet winding terminations and upwardly-rising lead portions, together with at least a portion of the sheet windings, are surrounded by a molding material and encapsulated with a potting material. A magnetic core surrounds at least a portion of the sheet windings to impart a desired magnetic property to the device. Thus, Pitzele, et al. disclose a bobbin-free, encapsulated, surface-mountable power magnetic device that overcomes the deficiencies inherent in, and therefore represents a substantial advance over, the previously-described power magnetic devices. However, several additional opportunities to increase power and volumetric density and lower profile in such power magnetic devices remain.

First, device leads typically extend substantially from the device footprint and therefore increase the area of the substrate required to mount the device. In fact, extended leads can add 30% to the footprint or 50% to the volume of the magnetic device. Second, termination co-planarity requires either the aforementioned devices be molded in a lead frame (requiring additional tooling and tighter tolerances) or the leads be staked in after molding (requiring an additional manufacturing operation). Third, the outer molding compound employed for electrical isolation and thermal conductivity adds both volume and cost and raises device profile.

Accordingly, what is needed in the art is a power magnetic device having an improved termination or lead structure and a structure that attains an acceptable electrical isolation and thermal conductivity without requiring a molding compound. Further, what is needed in the art is a method of manufacture for such devices.

SUMMARY OF THE INVENTION

To address the above-discussed deficiencies of the prior art, the present invention provides a surface-mountable magnetic device comprising: (1) a multi-layer circuit containing a plurality of windings disposed in layers thereof, the multi-layer circuit having first and second lateral recesses associated therewith, the first and second lateral recesses intersecting the layers of the multi-layer circuit, (2) a conductive substance disposed within the first and second lateral recesses and electrically coupling selected ones of the plurality of windings and (3) a magnetic core mounted proximate the plurality of windings, the magnetic core adapted to impart a desired magnetic property to the plurality of windings, the device locatable proximate a substantially planar substrate to allow the first and second lateral recesses to act as conductors between the plurality of windings and electrical conductors on the substantially planar substrate, the plurality of windings and the magnetic core substantially free of a surrounding molding material to allow the magnetic device to assume a smaller overall device volume.

In a preferred embodiment, the substantially planar substrate has a window defined therein, the magnetic core at least partially recessed within the window thereby to allow the magnetic device to assume a lower profile.

In a preferred embodiment, a solder at least partially fills the first and second lateral recesses to allow the first and second lateral recesses to act as conductors between the plurality of windings and the electrical conductors on the substantially planar substrate.

In a preferred embodiment, the multi-layer circuit comprises a lateral via located therethrough and intersecting the layers of the multi-layer circuit, a conductor disposed within the lateral via further electrically coupling the selected ones of the plurality of windings. The lateral via provides an additional path for electrical current, thereby increasing the current-handling capability of the device. Preferably, the lateral vias are substantially normal to the windings of the multi-layer circuit, however, the lateral vias include other orientations capable of coupling the windings together.

In a preferred embodiment, the first and second lateral recesses are formed by removing a portion of the multi-layer circuit. Alternatively, the recesses can be formed by trenching into walls of the multi-layer circuit. Preferably, the lateral recesses are substantially normal to the windings of the multi-layer circuit, however, the lateral recesses include other orientations capable of coupling the windings together.

In a preferred embodiment, the magnetic core surrounds and passes through a central aperture in the plurality of windings.

Alternatively, the magnetic core may either surround or pass through the central aperture.

In a preferred embodiment, the device further comprises a plurality of lateral recesses formed on opposing ends of the multi-layer circuit. The opposed lateral recesses are used For electrically and mechanically binding the device to the supporting substantially planar substrate.

In a preferred embodiment, the plurality of windings form primary and secondary windings of a power transformer. The plurality of windings can, however, form windings of an inductor or other magnetic device.

In a preferred embodiment, the magnetic device forms a portion of a power supply. However, those of skill in the art will recognize other useful applications for the power magnetic device of the present invention.

In a preferred embodiment, the magnetic core comprises first and second core-halves. Alternatively, the magnetic core may be of unitary construction and the windings formed about a central bobbin therein.

The foregoing has outlined rather broadly preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
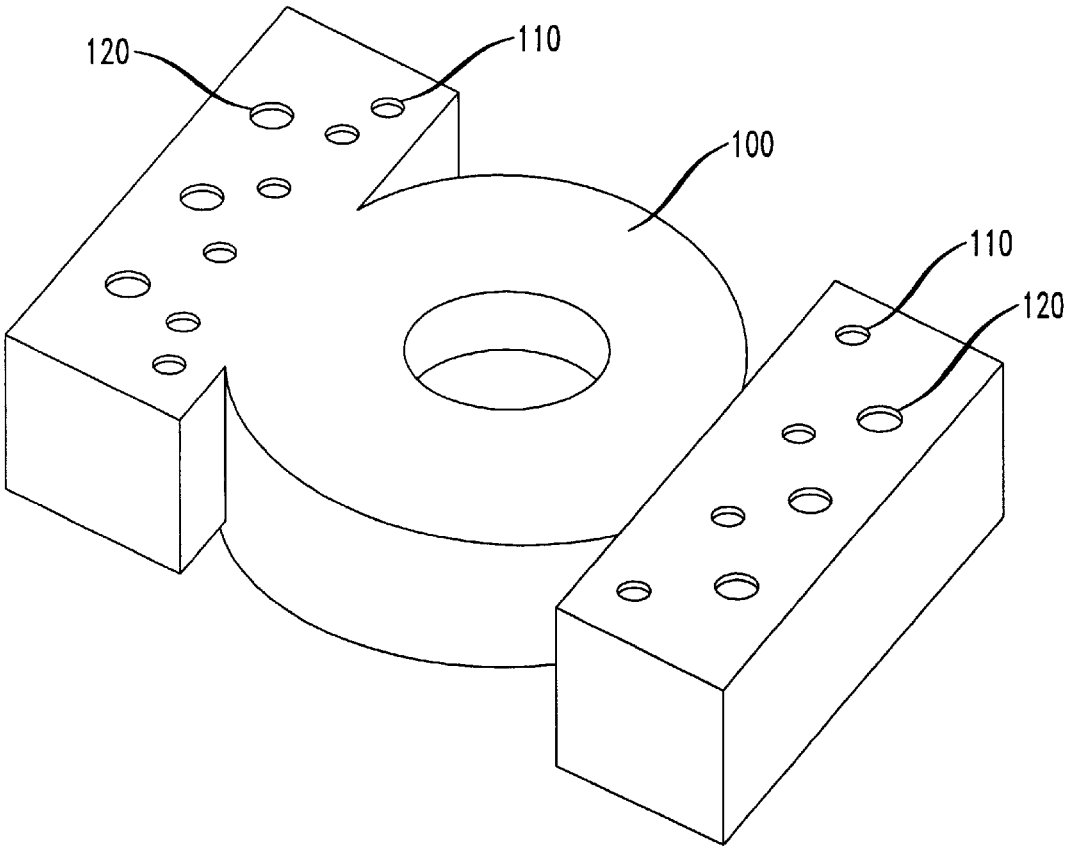
FIG. 1 illustrates an isometric view of the multi-layer flex circuit of the present invention.

Referring initially to FIG. 1, illustrated is an isometric view of the multi-layer circuit or multi-layer flex circuit 100 of the present invention. The multi-layer flex circuit 100 contains a plurality of windings (not shown) disposed in layers thereof. The plurality of windings can be of the same or different thicknesses and the number of windings may vary therein. Typically, the plurality of windings form primary and secondary windings of a power transformer. However, the plurality of windings can form windings of an inductor or other device.

The multi-layer circuit 100 includes a plurality of outer lateral vias 120 (some of which lateral vias 120 may be regarded as "first and second outer lateral vias") located therethrough and a plurality of inner lateral vias 110 ("further vias"). While the FIG. 1 illustrates a plurality of inner and outer vias 110, 120, it is appreciated that a single inner and outer via 110, 120 is within the scope of the present invention. The inner and outer vias 110, 120 intersect the layers of the multi-layer circuit 100. A conductive substance (not shown) is deposited within the lateral vias 110, 120 electrically coupling the plurality of windings located in the multi-layer flex circuit 100. The process of electrically coupling the plurality of windings as described is generally known in the industry as reinforced plating.

Figure 2:
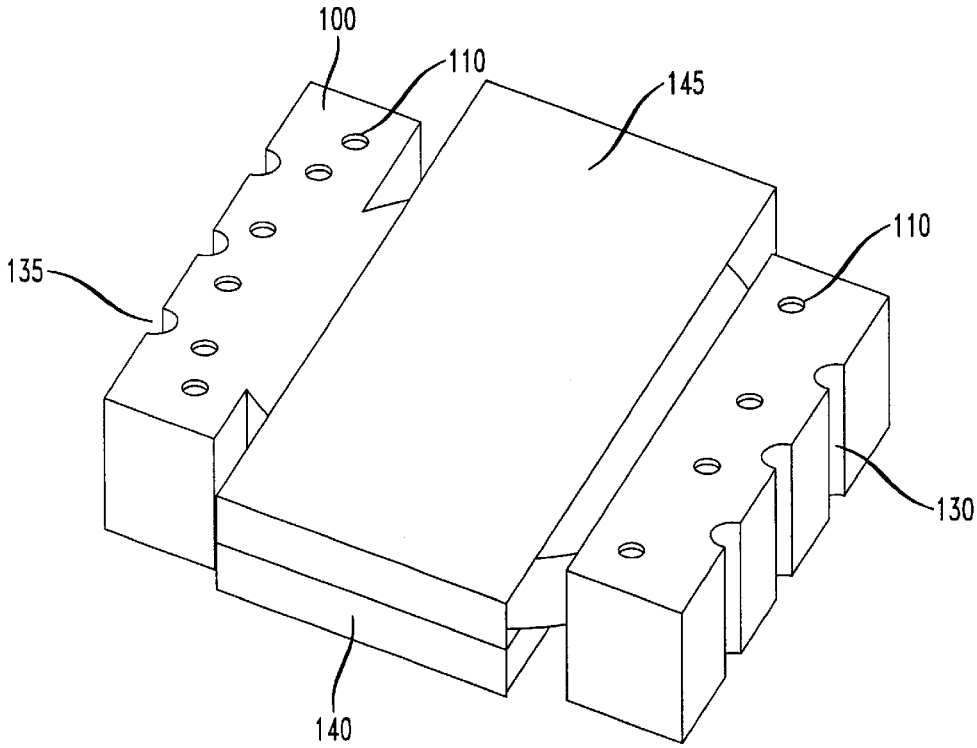
FIG. 2 illustrates an isometric view of the device of FIG. 1 prior to the step of mounting the device to a supporting substantially planar substrate.

Turning now to FIG. 2, illustrated is an isometric view of the device of FIG. 1 prior to the step of mounting the device to a supporting substantially planar substrate. The multi-layer flex circuit 100 has a first lateral recess 130 and a second lateral recess 135 associated therewith. The first and second lateral recesses 130, 135 are preferably formed by removing a portion of the multi-layer flex circuit 100. By this removal, the first and second outer lateral vias 120 become the first and second lateral recesses 130, 135 in the wall of the multi-layer flex circuit 100.

The first and second lateral recesses 130, 135 intersect the layers of the multi-layer flex circuit 100 and are generally formed on opposing ends of the multi-layer flex circuit 100, although it should be appreciated that other orientations are within the scope of the present invention. The conductive substance (not shown) previously deposited within the outer lateral vias 120, now transformed into the first and second lateral recesses 130, 135, electrically couples the plurality of windings (not shown) in the multi-layer flex circuit 100.

A magnetic core, comprised of a first core half 140 and a second core half 145, surrounds and passes through a substantially central aperture of the multi-layer flex circuit 100. Alternatively, the magnetic core may be of unitary construction. The magnetic core is typically fabricated out of a ferromagnetic material, although other materials with magnetic properties are also within the scope of the present invention. The magnetic core imparts a desired magnetic property to the multi-layer flex circuit 100. The multi-layer flex circuit 100 and the first and second core halves 140, 145 are substantially free of a surrounding molding material to allow the magnetic device to assume a smaller overall device volume and elevational profile.

Figure 3:
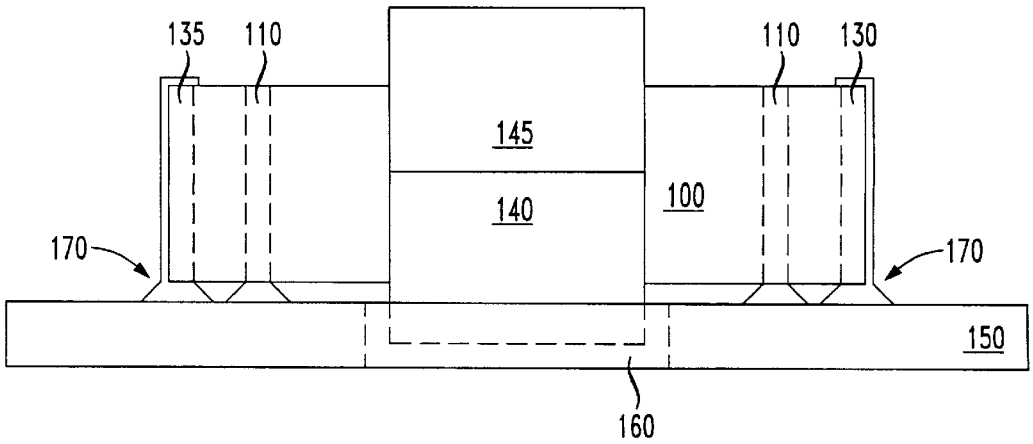
FIG. 3 illustrates an elevational view of the device of FIG. 2 after the step of mounting the device to the supporting substantially planar substrate.

Turning now to FIG. 3, illustrated is an elevational view of the device of FIG. 2 after the step of mounting the device to a supporting substantially planar substrate 150. The device, comprising the multi-layer flex circuit 100, in combination with the first and second core halves 140, 145, advantageously forms a portion of a power supply. However, those of skill in the art will recognize other useful applications for the magnetic device. The planar substrate 150 is typically a PCB or PWB.

In FIG. 3, a window 160 is defined within the planar substrate 150. The window 160 provides a recess for the first or second core half 140, 145 thereby allowing the magnetic device to assume a lower profile.

In one embodiment, a plurality of solder connections 170 are created between the planar substrate 150 and the first and second lateral recesses 130, 135 and the inner vias 110. The solder connections 170 secure the magnetic device to the planar substrate 150, and allow the first and second lateral recesses 130, 135 and the inner vias 110 to act as conductors between a plurality of windings (not shown) in the multi-layer flex circuit 100 and electrical conductors on the planar substrate 150. Although the illustrated embodiment represents the first and second lateral recesses 130, 135 as fully exposed, it is understood that the first and second lateral recesses 130, 135 may be fully enclosed similar to the inner vias 110.

Now referring to FIGS. 1–3, a method for manufacturing the magnetic device encompassing the present invention will be described in greater detail. The process commences with manufacturing the multi-layer flex circuit 100. As previously addressed, the multi-layer flex circuit 100 is comprised of a plurality of windings or planar conductors. The multi-layer flex circuit 100 is cut, establishing the inner and outer lateral vias 110, 120. The inner and outer lateral vias 110, 120 intersect the layers of the multi-layer flex circuit 100. Next, a conductive substance (not shown) is deposited within the inner and outer lateral vias 110, 120 to electrically couple the plurality of windings. The lateral vias also provide a conductive path between the plurality of windings.

After the conductive substance is deposited on the inner and outer lateral vias 110, 120, the lateral recesses are created. The first and second lateral recesses 130, 135 are formed by removing a portion of the multi-layer flex circuit 100, namely, by removing or cutting a portion of the outer lateral vias 120. Alternatively, the recesses can be formed by trenching into the walls of the multi-layer flex circuit 100. This removing step of the process exposes the first and second lateral recesses 130, 135 on opposing ends of the multi-layer flex circuit 100.

After the multi-layer flex circuit 100, with the inner lateral vias 110 and the first and second lateral recesses 130, 135, is prepared, an epoxy adhesive is then applied to the first core half 140 and the first and second core halves 140, 145 are rung together around a central portion of the multi-layer flex circuit 100. The magnetic cores are twisted to ring the adhesive and create a very minute interfacial bond line between the first and second core halves 140, 145. The magnetic core is adapted to impart a desired magnetic property to the multi-layer flex circuit 100.

The magnetic device is then mounted on the planar substrate 150. The mounting procedure commences by depositing solder paste at a plurality of terminal sites on the planar substrate 150. The magnetic device is then placed on the planar substrate 150 at the terminal sites. The planar substrate 150 is provided with a substantially rectangular portion removed to create a window 160 in the planar substrate 150 that matches the outline of the magnetic core. The magnetic device is now physically mounted on to the planar substrate 150.

The first core half 140 of the magnetic core is recessed into the window 160 located in the planar substrate 150 to reduce the overall elevational profile of the magnetic device. As previously mentioned, the magnetic device is substantially free of a surrounding molding material to allow the magnetic device to assume even a smaller overall device volume.

By eliminating the device-surrounding molding material, the device assumes a lower profile and smaller overall volume. It has been found that elimination of the molding material causes an increase in operating temperature, albeit minimal. However, this minimal increase in temperature has no effect on the device's operation and the device safely meets the requirements of the customer in a compact cost effective design. Furthermore, since the device is intended to be joined to an underlying PCB containing other components of a power supply and then potted or encapsulated together as a unit, the differential is likely to be decreased.

Solder is then applied to the first and second lateral recesses 130, 135 and to the inner lateral vias 110. A solder reflow process is then performed. The solder reflow process firmly establishes the solder connections 170 to secure the magnetic device to the planar substrate 150. The first and second lateral recesses 130, 135 and the inner lateral vias 110 therefore act as conductors between the plurality of windings (not shown) in the multi-layer flex circuit 100 and electrical conductors on the planar substrate 150.

The method of manufacture of the present invention reduces material and assembly costs by simplifying the solder processes, and eliminating molding and termination operations. This method also addresses and solves the co-planarity and dimensional issues associated with surface mount components by eliminating the need for a bobbin or header, by foregoing a molding compound, and by recessing the magnetic core in the window 160 of the planar substrate 150. Finally, the method can be highly automated with the only hand labor involved being in the traditional magnetic core assembly process.

Although the present invention has been described in detail, those skilled in the art should understand that they can make various changes, substitutions and alterations herein without departing from the spirit and scope of the invention in its broadest form.

What is claimed is:

1. A method of manufacturing a magnetic device mounted on a planar substrate, comprising:

providing a multi-layer circuit containing a plurality of windings disposed in layers thereof, said multi-layer circuit having first and second lateral vias associated therewith, said first and second lateral vias intersecting said layers of said multi-layer circuit;

depositing a conductive substance within said first and second lateral vias, said conductive substance electrically coupling selected ones of said plurality of windings;

removing a portion of said multi-layer circuit, said first and second lateral vias thereby becoming first and second lateral recesses in a wall of said multi-layer circuit;

forming a magnetic device by mounting a magnetic core proximate said plurality of windings, said magnetic core adapted to impart a desired magnetic property to said plurality of windings, said plurality of windings and said magnetic core being substantially free of a surrounding molding material to allow said magnetic device to assume a smaller overall device volume; and locating said magnetic device proximate a substantially planar substrate having electrical conductors thereon such that said first and second lateral recesses act as conductors between said plurality of windings and said electrical conductors on said substantially planar substrate.

2. The method as recited in claim 1 wherein said substantially planar substrate has a window defined therein, said locating comprising at least partially recessing said magnetic core within said window thereby to allow said magnetic device to assume a lower profile.

3. The method as recited in claim 1 further comprising at least partially filling said first and second lateral recesses with a conductive substance, said method further comprising conducting electricity between said plurality of windings and said electrical conductors on said substantially planar substrate via said first and second lateral recesses.

4. The method as recited in claim 1 wherein said multi-layer circuit comprises a further lateral via located therethrough and intersecting said layers of said multi-layer circuit, a conductive substance disposed within said further lateral via further electrically coupling said selected ones of said plurality of windings.

5. The method as recited in claim 1 further comprising reflowing solder over said first and second lateral recesses.

6. The method as recited in claim 1 wherein said locating comprises surrounding said plurality of windings with said magnetic core, said magnetic core passing through a central aperture in said plurality of windings.

7. The method as recited in claim 1 wherein said removing exposes a plurality of lateral recesses on opposing ends of said multi-layer circuit.

8. The method as recited in claim 1 further comprising operating said plurality of windings as primary and secondary windings of a power transformer.

9. The method as recited in claim 1 wherein said magnetic device forms a portion of a power supply.

10. The method as recited in claim 1 wherein said locating comprises joining first and second core-halves to form said magnetic core.

* * * * *